US007263727B1

(12) United States Patent
Zhurin et al.

(10) Patent No.: US 7,263,727 B1
(45) Date of Patent: Sep. 4, 2007

(54) HYGIENIC HIGH DETERGENCY TOILET

(75) Inventors: Viacheslav V. Zhurin, 548 Charrington Ct., Fort Collins, CO (US) 80525; Lyudmila V. Zhurin, Fort Collins, CO (US)

(73) Assignee: Viacheslav V. Zhurin, Fort Collins, CO (US)

( * ) Notice: Subject to any disclaimer, the term of this patent is extended or adjusted under 35 U.S.C. 154(b) by 0 days.

(21) Appl. No.: 11/361,151

(22) Filed: Feb. 24, 2006

(51) Int. Cl.
*E03D 1/00* (2006.01)

(52) U.S. Cl. ..... 4/300

(58) Field of Classification Search ..... 4/300, 4/300.3, 420

See application file for complete search history.

(56) References Cited

U.S. PATENT DOCUMENTS

| | | | | |
|---|---|---|---|---|
| 3,383,710 | A * | 5/1968 | Carmichael | 4/300.3 |
| 3,585,649 | A * | 6/1971 | Miya | 4/300 |
| 3,843,976 | A * | 10/1974 | Miya et al. | 4/300 |
| 4,571,752 | A * | 2/1986 | Bick | 4/300 |
| 5,429,279 | A | 7/1995 | Van Der Heijden | |
| 5,443,569 | A | 8/1995 | Uehira et al. | |
| 5,813,576 | A | 9/1998 | Iizuka et al. | |
| 5,813,785 | A | 9/1998 | Baudin et al. | |
| 5,983,413 | A | 11/1999 | Hayashi et al. | |
| 6,427,875 | B1 | 8/2002 | Hoang et al. | |
| 6,818,204 | B2 | 11/2004 | Lapidus | |
| 6,986,172 | B2 | 1/2006 | Hidetaka et al. | |
| 2006/0005310 | A1 | 1/2006 | Nakamura et al. | |

* cited by examiner

*Primary Examiner*—Charles E. Phillips

(57) ABSTRACT

In accordance with an embodiment of the invention, the hygienic toilet with a user protection from evacuations is designed. A self-foaming liquid soap as a high efficiency absorbing substance is used from contaminations produced during evacuations. A water tank is comprised of two compartments: one is for flashing water that could be a regular gravity tank, or a pressure assisted flash water, and a separate compartment is for a self-foaming liquid soap. A toilet bowl is designed with two rims: one is for a flashing water and another one for a soap foam. A soap foam is applied into a bowl walls and on a water surface on a bowl bottom for protection from evacuations and reflections into a user. Analysis of a liquid flow in a toilet bowl made possible to utilize a theory of surface waves in a bowl exit outlet designed in the form of a converging-expanding channel with a high velocity liquid flow through the toilet bowl without disturbances and atomizing effects and providing a maximum efficiency detergency of bowl walls.

4 Claims, 4 Drawing Sheets

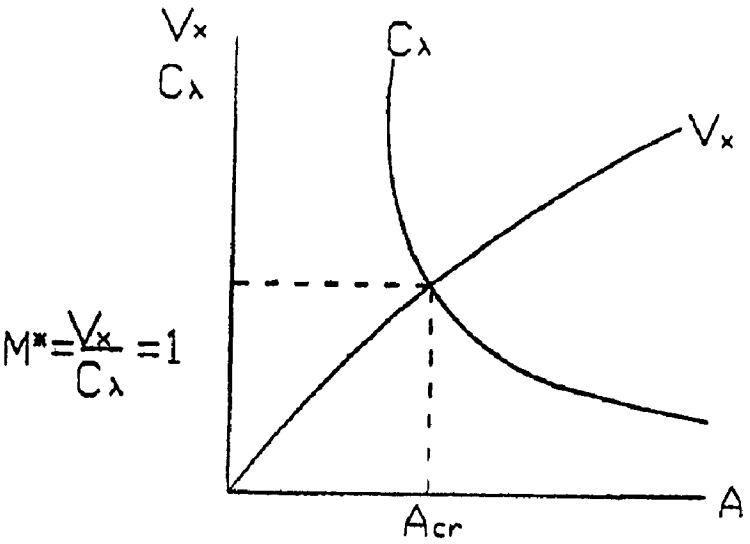
Fig. 1b
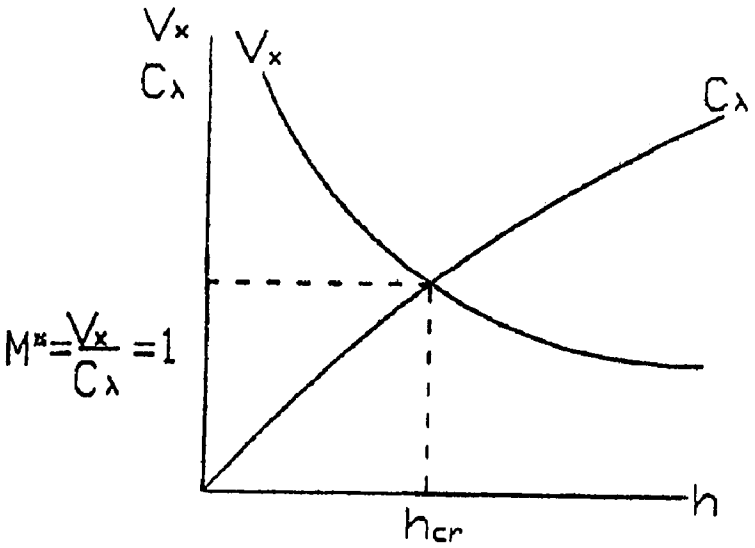
Fig. 1a
Fig. 1

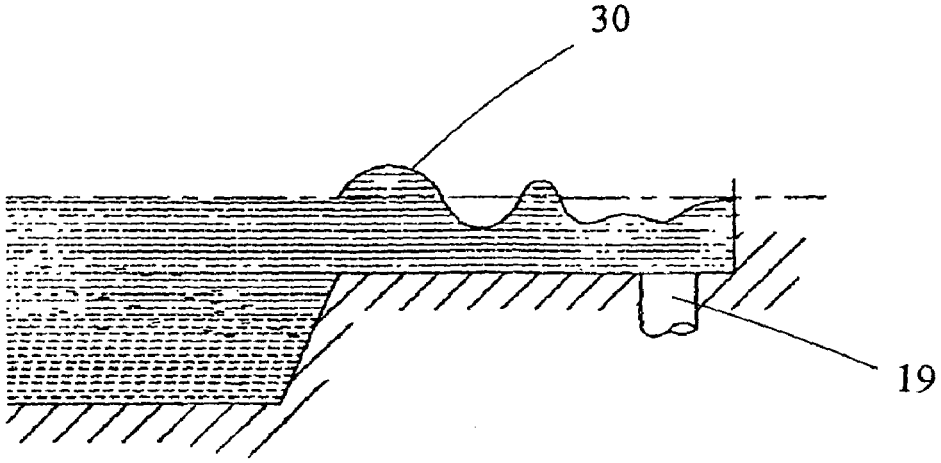
Fig. 3b
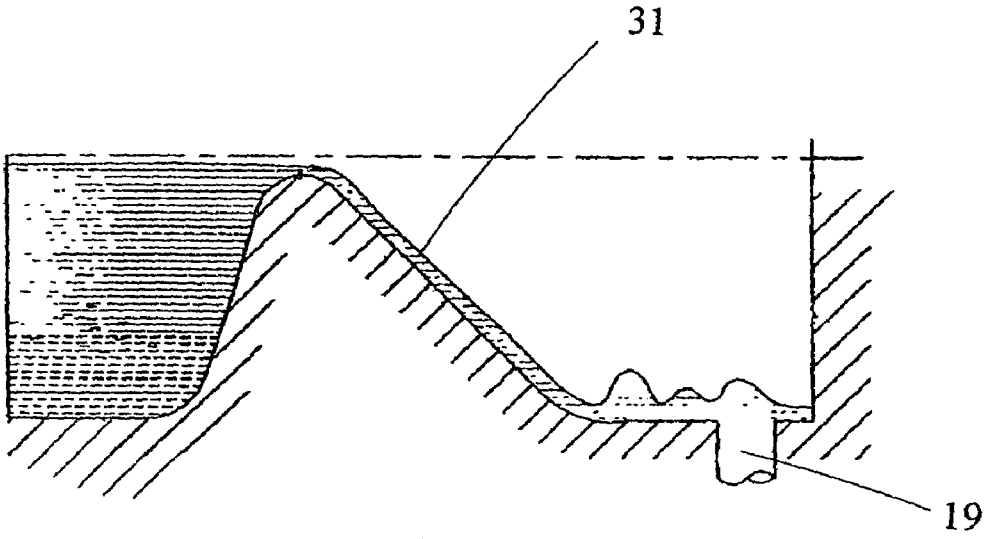
Fig. 3a
Fig. 3

HYGIENIC HIGH DETERGENCY TOILET

BACKGROUND OF THE INVENTION

FIELD OF THE INVENTION

This invention relates generally to the field of development of the hygienic toilets, and more specifically to the toilets equipped with means for protection of users from residues of previous users and their own contaminations during utilization of a toilet facility. Also this invention relates to designing a toilet bowl with fast motion of flashed water that facilitates high detergency efficiency of evacuations.

Many people believe that sharing a toilet seat is like sharing a toothbrush or bath towel with strangers. This risk people take everyday in public restrooms, such as hotels, airports, hospitals, schools, even at homes. However, a toilet seat can be washed and cleaned, covered with paper, or material before use. The most dangerous part is inside a toilet itself, from its walls and from the contents of a bowl. During evacuation process humans produce solid and liquid waste that makes splashes during contact with water in a bowl and with bowl walls. These splashes reflect person's evacuations, previous residues and send back to this person. Together with this flow of own evacuations there are droplets, pieces and other particles attached to bowl walls that reflect to a person. There are data that splashes from a toilet bowl can project reflections of liquids and solid particles substantially over 10 feet in the air.

Historically, toilets always were a "weak" point in human culture. During several thousand of years humans always suffered from their own evacuations and never had clean nice hygienic toilets. Last century, especially, in 1980-1990s significant progress was achieved in improvement of toilets. The latest concern was about water consumption for toilets. In 1995 the National Energy Policy Act went into effect that required using 1.6 gallon water toilets for the entire US. The new standard was quite a big change from 5.5 gallons in 1960s and 3.5 gallons in 1980s. However, there was little done about providing humans with better hygienic toilets. Though there were various inventions for improvements of better detergency efficiency from a flashed water.

Companies-producers of toilets and accompanying equipment came with variety of solutions for general toilet performance such as re-engineerings a water tank with different flashing technologies, with redesign of toilet bowls utilizing modern approaches in hydrodynamics like a cyclonic motion of water with waste, covering bowl with non-sticking glaze, disinfections of a seat and a toilet bowl by a flashed water with disinfectants, and even utilizing computer technology for obtaining user's evacuation sample analysis.

Here are some other expensive improvements in technology of toilets such as: 1. automatic opening-closing lid; 2. various ways of bowl cleaning; 3. hand-free automatic flush; 4. warm-in air purifying system; 5. oscillating/pulsating washing; 6. warm air dryer, and other complex and expensive gadgets. They certainly make life of toilet user easier and safer. However, even several washings of bowl by water and disinfectants do not completely eliminate microbes, bacteria and viruses from toilet bowl walls and from water contaminated with human waste. It is known fact that despite that urine itself is sterile, but a residual urine can breed bacteria, leading to a urinary-tract infection. Solid evacuations from sick people have microbes, bacteria and viruses that can stick to bowl walls. Also healthy people have microbes, bacteria and viruses that can be dangerous to others. Splashes and "misses" from evacuations work like projectiles and contaminate users of a toilet bowl. In other words, any expensive toilets can spray fecal-infected water into the air on bowl's walls and on the user. The important conclusion: there are no safe hygienic toilets available. The safest hygienic toilet is your own one at home, which you disinfect after each usage (who does it?) comparatively to others that everyone has to utilize from time to time in public places.

In a Cooperative Canadian and American Project "Maximum Performance Testing of Popular Toilet Models" by W. Gauley and J. Koeller, Final Report, December 2003 there were tested varieties of toilets of major world toilet producing companies (such as Toto, American Standard, Koehler and many others) for toilets operation such as a flush performance of human waste and a water exchange test. In a water exchange test there was measured a capability of toilets for a removal of a brine mixture utilizing an electrical conductivity meter. About 20 ml of 18 gram/liter salt solution were added to a test bowl and dissolved. An electrical conductivity of water was measured and recorded. Then, a toilet was flashed and refilled. A refilled water electrical conductivity in a test bowl was again measured and recorded. From here a percentage of water change-out was calculated. All tested models achieved a change-out rate of at least 98 percent. Also, it was noted that there were problems with toilets that failed to remove solid and liquid waste, when both solids and liquids were being flushed. From these tests one can conclude that remaining less than 2 percent of dissolved waste would present problems to users during next toilet operation, because most people have microbes, bacteria and viruses in their waste evacuations.

SUMMARY OF THE INVENTION

In the light of foregoing, it is an object of the invention to introduce a hygienic toilet with a water tank and a bowl of a design based on the analysis of a liquid flow, and a method providing a hygienic toilet for protection of users from contaminations that take place during users evacuations.

Another object of the present invention is to introduce a high efficiency absorbing substance for protection of toilet users from contaminations produced during evacuations in the form of a self-foaming liquid soap applied into a toilet bowl from a tank comprising of two-compartments: one is for a water flush and another is for a self-foaming liquid soap.

Still another object of the present invention is a design of a toilet bowl comprising of two separate rims on a top of a bowl: one is for a flash water flow and another one for a liquid self-foaming soap flow. A water rim has a plurality of small holes (over 15 and up to 50) of 4-6 mm in diameter for water, and a foam rim has a plurality of larger holes (over 10 and up to 30) of 8-15 mm in diameter for a soap foam flow. A foam rim can be connected together with a water rim for regular washing with water through a foam rim, if necessary.

Yet another object of the present invention, instead of a passive water flash from a water tank, it is envisaged a utilization of a service water from a regular municipal water line of 1.6 gallon volume at higher pressure of about 60 psi, or a small pump for amplification of water pressure over 50 psi from a regular water tank. This higher water pressure is utilized for obtaining higher water velocities in a bowl thus providing better detergency efficiency of a toilet bowl for washing out evacuations and contaminations of a bowl surface.

A further object of the present invention is a design of a bowl with exit outlet of water with evacuations at higher pressure and velocity to ensure optimum removal of evacuations and a high detergency efficiency. This exit outlet is designed in a form of a nozzle (converging-expanding channel) for obtaining maximum efficiency and higher velocity of evacuating flow.

BRIEF DESCRIPTION OF DRAWINGS

Features of the present invention which are believed to be patentable are set forth with particularity in the appended claims. The organization and operation manner of the invention, together with further objectives and advantages thereof, may be understood by reference to the following descriptions of specific embodiments taken in connection with accompanying drawings, in the several figures of which like reference numerals identify similar elements and in which:

FIG. 1 presents graphical dependencies of a velocity of liquid's surfaces waves $C_\lambda$ and a flow velocity $V_x$ as a function of a liquid flow thickness h. In FIG. 1*b* there are presented graphical dependencies of a liquid surface wave velocity $C_\lambda$ and a liquid flow velocity $V_x$ as a function of a geometrical non-dimensional parameter A.

FIG. 3*a* presents a picture explaining transitions from undercritical regime of flow in a regular long channel leading to a flow with discontinuities arising from friction and wave interactions. FIG. 3*b* presents a liquid flow with flow motion experiencing a critical and supercritical regime in a converging-expanding channel when there are no discontinuities in vicinity of a converging-expanding area.

In FIG. 4 there is shown a toilet bowl with two separate rims: one rim is for flashing water with placement of small holes that provide a flow of flashing water for washing out evacuations and water, and another rim is for a soap foam with placement of larger holes that provide a flow of a soap foam for filling in a bowl surface and a water surface at a bowl bottom. And FIG. 4 presents a schematic drawing of a toilet bowl showing a bowl's exit outlet with a converging-expanding channel for obtaining optimum detergency efficiency of a bowl by high velocity, high pressure liquid flow with a vortex.

FIG. 4 also presents a schematic drawing of a toilet bowl with geometric dimensions for understanding of application of the hydrodynamic flow theory in a bowl with a vortex and its main dimensions. These dimensions of a toilet bowl are as follows: $R_{in}$ is a radius of a bowl internal side where water enters from a water tank through inlet orifices of a radius $r_{in}$; $r_n$ is a radius of a bowl converging expanding channel serving as a bowl exit outlet in a narrow cross section of this channel; $r_v$ is a vortex radius in a bowl's liquid flow.

DESCRIPTION OF THE PREFERRED EMBODIMENTS

Figure 2:
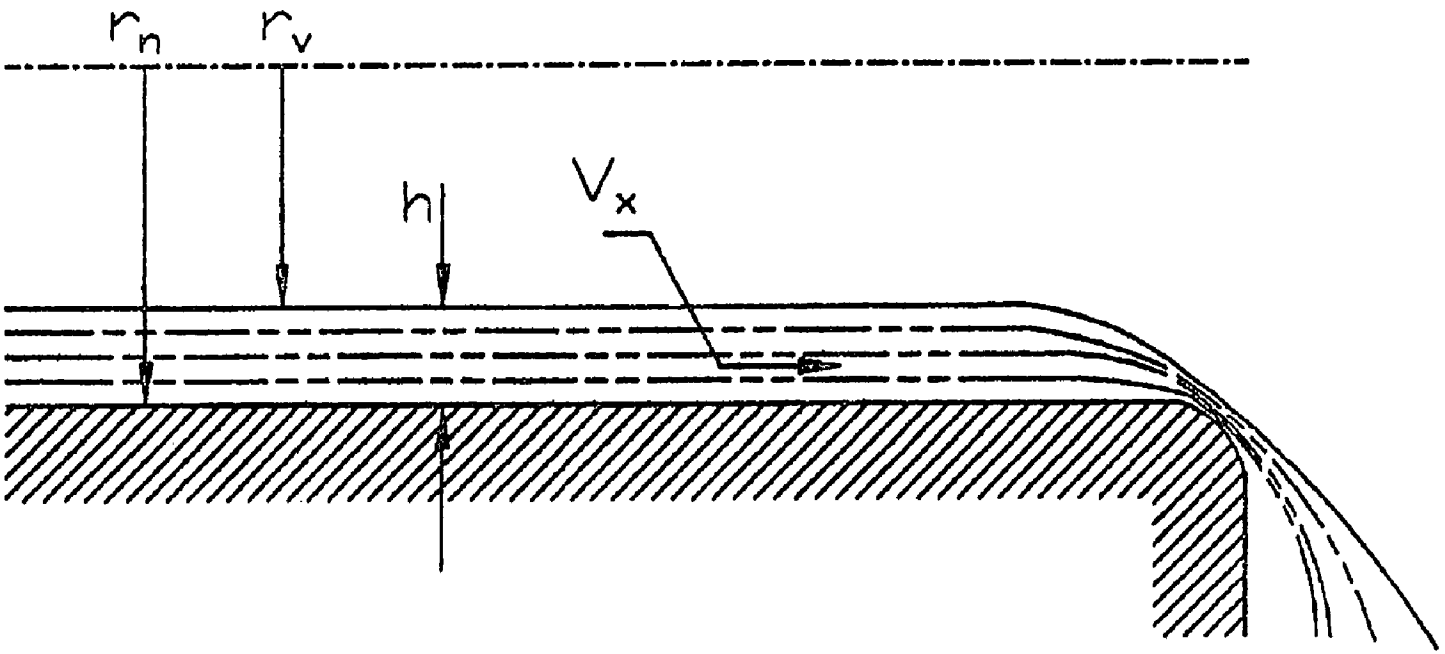
FIG. 2 presents a schematic drawing for a liquid flow explaining the main assumptions of a "shallow water" theory. Letters $r_n$, $r_v$, h and $V_x$ are a radius of a converging expanding channel (nozzle) in its narrow cross section, a radius of a gas (air) vortex of a flow that takes place in a toilet bowl, a thickness of a liquid (water) flow and a velocity of a liquid (water) flow in a bowl, correspondingly.

What is the solution to the problem of preventing toilet user from bowl contaminations and having a hygienic toilet? One of the solutions is the utilization of a toilet bowl walls and a water surface covered with a material, or a substance during a contact of urine and solid evacuations with bowl's walls and water on a bowl exit outlet that do not reflect contaminating particles. In other words, there must be utilized a substance that can absorb urine and solid evacuations and will not reflect any parts of evacuations back into a user. A good candidate for this task is foam and, especially, foamy disinfecting soaps and its compositions. Recent improvements in soap production technology made possible to utilize a self-foaming soap that is easy available and inexpensive.

Foam presents itself a large group of bubbles composed of a gas-liquid phase. The process of foam development takes place during gas dispersion in a liquid medium and formation of a new gas-liquid phase in a form of large groups of bubbles in a liquid's volume. The creation of stable highly dispersion foam is provided by additives of foam stabilizers or foam developers. Soap bubbles can exist due to a surface tension force. This force is caused by the attraction between molecules of a soap film. The present invention relates in general to the utilization of self-foaming antibacterial liquid soap compositions that provide necessary surface tension between soap bubbles and prevent bubbles from destruction for a reasonable time of 15-20 minutes. In particular, the invention relates to a self-foaming antibacterial soap that can cover walls and a toilet bowl surface that can protect these walls and a bowl water surface during user's evacuations in a way that the evacuations during interactions with toilet bowl walls and a water surface will be absorbed by a soap foam without reflections back into a user. Soap foamy composition forms protective absorbing layer that prevents from reflections. The use of foam generating equipment till recent times was a cumbersome and time consuming. However, the latest advances in development of self-foaming devices that are inexpensive and simple make this problem easy to solve. In this case, there is no need for the foam generating devices.

Self-foaming devices described in the patents U.S. Pat. No. 5,813,785 "Device for Packaging, Dispensing and Application of a Gel or Foam" by G. Baudin et al, U.S. Pat. No. 6,427,875 "Foam Dispensing Device" by M. Q. Hoang et al, U.S. Pat. No. 6,818,204 "Stable Foam for Use in Disposable Wipe" by H. Lapidus, and U.S. Pat. No. 5,429,279 "Mixing Chamber for Mixing Together a Gaseous and a Liquid Constituent" by E. Van Der Heijden present various approaches in development of self-foaming gels and soaps. Self-foaming liquid soaps can have compositions including ingredients with disinfecting substances. Foaming is a simple and economical way to provide a mechanical barrier between a user and evacuations where disinfecting ingredients are self-foaming when mixed with water.

Our research was carried out to determine the necessary thickness of self-foaming antibacterial soaps for producing stable foam of the desired properties such as density of developed foam, its optimum thickness (that still does not stop foam development), drying up time of foam upper layers (that are in immediate contact with surrounding air) that depends on a surrounding air humidity, pressure, its temperature and a foam chemical composition.

Foam of liquid soap of major U.S. soap producers is utilized in our invention. Such foam is determined as a uniform gas distribution (usually air) in a form of bubbles in a liquid phase. The characteristic feature of a liquid foam in comparison with other physical phenomena is quite a large boundary surface between gas and liquid. This surface called lamella, which is a thin liquid film around a gas bubble. Such surface separates gas bubbles from each other. In general, any liquid is trying to achieve state where the surface energy is minimized. Since foam represents itself a high-energy state, one can conclude that foam exists only with a foam stabilizing factors provided by most liquid self-foaming soaps.

Gas bubbles after their development rise to a liquid's surface and move through as a foam, which can be considered as a liquid-gas state with a certain viscosity. According to a Stokes law, a bubble's floating up velocity in a field of gravity forces depends on a bubble's radius ($a^2$) and on a liquid viscosity ($\mu=\nu\rho$):

$$v=\rho g a^2/3\mu, \quad (1)$$

Where $\rho$ is a liquid's density; a is a bubble's radius; $g\approx 9.81$ m/sec$^2$, v is a kinematic viscosity; $\mu$ is a dynamic viscosity. This formula holds at Re<<1 (Re=vl/v is a Reynolds number that shows a ratio between inertia and friction forces in a liquid flow, l is a characteristic linear dimension of a flow), i.e. when this inequality holds: $ga^3/3v^2<<1$. During development of a gas bubble in liquid such as water with a self-foaming soap one can have a foam with bubbles of a radius of $a\approx 1\text{-}5$ mm$=(1\text{-}5)\times 10^{-1}$ cm. At a bubble's radius of a=1 mm$=1\times 10^{-1}$ cm and with a water viscosity $v=1\times 10^{-4}$ cm$^2$/sec one can have a bubble's floating up velocity $v\approx 10^{-2}$ cm/sec. Our experiments with liquid soap show that its viscosity is about $v\approx 1$ cm$^2$/sec and a bubble's up floating velocity is $v\approx 3\times 10^{-5}$ cm/sec. In other words, foam of 1 cm thickness can stay practically without change during $3\times 10^4$ sec, or for about 8 hours, unless the other physical processes change a bubble's shape.

These estimations are approximate but they are reasonable. There are some data about a soap foam viscosity, but various soaps have different viscosities depending on chemical compositions. When typical gas bubble achieves liquid's surface, liquid (soap solution in water) flows down of a bubble under a gravity force and correspondingly flows down from a foam's lamella. This is called a "drainage effect". When lamella's wall thickness becomes thinner than 10 nm, lamella loses its stability and bubble bursts.

Gas bubbles moving through pure clean liquid do not develop foam. As was above mentioned, in order to develop foam bubbles in liquid phase there must be introduced foam-stabilizing substances. In general, such substances develop activity on an inter-phase boundary of a bubble, which is characterized by a presence of hydrophobic or hydrophilic subgroups. Such substances are oriented in the direction to an inter-phase boundary liquid-gas; they increase surface tension and, correspondingly, provide a basis for development of a stable foam.

Real soap foam (froth) is notoriously fragile, far from equilibrium, and a subject to well-known physical processes such as coarsening, drainage and film rupture. Still, the most known soap film is a round soap bubble. Soap bubble having soap stabilizing substances do not implode easily, because as a soap bubble starts to contract, air inside a bubble produces a higher pressure than air on outside a bubble. An inside air pushes outward on a soap bubble surface. A bubble becomes at its equilibrium in a sphere which inward surface tension balances this outward push. For this invention it is sufficient to have stable, reasonably dense soap foam during 15-20 minutes that is supposed to stay in a toilet bowl during person's evacuations. This stable dense soap foam serves as a membrane between a bowl water that is under foam over a bowl exit outlet, bowl walls and a person's body.

There are studies of soap foam for a foam ability, foam stability, and other properties that are important for soap users and that are valuable for implementation of foam for a hygienic toilet operation. In article "Cooperativity Among Molecules at Interfaces in Relation to Various Technological Processes: Effect of Chain Length on the $pK_a$ of Fatty Acid Salt Solutions" by J. R. Kanicky et al, Langmuir Journal, 16 (1), pp 172-177, 2000, there are presented experimental results of a sodium laurate soap and other films of fatty acid salts at various pH values of the solutions. It was found that a maximum foam ability and foam stability depends on a sodium laurate pH values. The optimum soap properties such as a foam lifetime, a foam stability and a foam height (foamability) are at a soap pH=7.5. A foam half-life is determined as the time required for a foam to collapse to half of its original height. Some interesting results of this articles showed that a 0.05 wt % sodium laurate solution can produce foam up to 55 cm in height with a half lifetime of 6 minutes (from 55 cm to about 27 cm). Actually, a foam lifetime is longer with shorter heights. A pH that determines the acidity or alkalinity of a soap solution is quite close to pH=7 for neutral solutions. In other words for a hygienic optimum toilet operation a soap with pH=7.5 that the most favorable to human skin is quite acceptable.

Our experiments with various commercially produced liquid soaps showed that it is not necessary to make special compositions of liquid soap with properties of being stable and dense. Available self-foaming liquid soaps manufactured by AirSpray International, by Dial Corporation, and others operate without the use of gas propellants or the like with finger actuated pumps. Such finger actuated mechanical pumps are described in U.S. Pat. No. 5,443,569 by Shoji Uehira et al, and U.S. Pat. No. 5,813,576 by G. Baudin et al and can be used for purposes of the present invention with some modifications. These mechanical pumps have a spring-loaded valve system and during actuation precise amounts of air and liquid are mixed and one can have a soap foam maintaining its structure for substantial period of time necessary for person's evacuations.

Our experiments with various light and moderately heavy projectiles and liquid's flows imitating evacuations showed that from about a half and up to one inch layer of a soap foam applied over a toilet bowl exit outlet do not produce any visible and measurable splashes from a surface covered with foam in comparison with a regular water surface.

Further experiments were done with flashing a self-foaming soap and with imitations of evacuations. There was no observable malfunctioning of evacuations flashings during the experiments. All imitation evacuations together with a self-foaming soap need just one flash of water from a water tank of standard capacity of 1.6 gallon. Certain additives into a liquid soap such as antibacterial liquids and fragrances help to observe a very high quality hygienic operation of this invented hygienic toilet.

One of the approaches for implementation a self-foaming soap for the invented hygienic toilet is the utilization of a tank comprising of two separate compartments: one is for regular 1.6 gallon water volume and another for a smaller 0.25-0.5 gallon with a liquid self-foaming soap.

Since everybody observed foam in a form of a large group of soap bubbles, which always look very fragile and easy to be destroyed, there could be a concern if foam supplied from a foam compartment will be able to move through a bowl rim, which is usually designed in a shape of a hollow toroidal space under a bowl rim. The experiments with a soap foam motion through tubes of different diameters and lengths showed that a soap foam applied from standard liquid self-foaming soap bottles moves quite well through long tubes up to 2 m length and 10-20 mm in diameter without noticeable destruction of soap bubbles. The application of foam through a bowl rim also showed that a soap foam moves easily from a bowl rim into a bowl area and spreads quite uniformly over a water surface. Practical usage of a soap foam makes possible to apply a layer of foam of 0.5"-1.0" thickness into a bowl wall and a water surface in a matter of several seconds.

Simple calculations analyzing operation of modern toilet with gravity flashed water tanks show that for a typical toilet having a water tank of about 0.5 m of water highest level over a toilet bowl rim a velocity of water flow, v, at inlet orifice into a bowl rim is $$v=(2gh)^{1/2}, \quad (2)$$

Where g is the Earth gravity acceleration (about 9.81 m/sec$^2$), and h is a height from which water falls down. In this case, h is about 0.5 m and v≈3.1 m/sec. A water discharge time from a water tank with a height of about 0.5 m is about 0.3 sec. Taking into account a water flow through bowl rim holes, a water velocity will be higher in several times (due to the mass flow conservation equation: $m=\rho vS=\rho v_r nS_r$, where S is inlet orifice area, $v_r$ is a water velocity at exit of a bowl's hole, $S_r$ is area of one hole in a bowl's rim, n is a number of holes; and since every rim has about 26-32 holes, a water velocity will be increased about proportionally to $S/nS_r$, or in this case by about 2.7 times for $r_{in,orifice}$=2.5 cm and $r_{in,hole}$=0.3 cm), because a total area of bowl holes is smaller than area of an inlet orifice.

In principle, smaller a hole, higher a water velocity at a hole exit. Dimension of bowl holes is determined by the facts that with a hole diameter less than 0.5 mm a carrying capacity of a hole becomes reduced due to increasing role of friction and water surface tension. Also, since water contains certain impurities and salts, small holes could be clogged by depositions from impurities and salts. Another important aspect in designing a number of toilet bowl holes is about an optimum number of such holes. We recommend to place holes with a distance equal to at least two diameters of a hole, because, as our experiments showed, during a water flow through a hole there is realized a water flow swirling effect, which diameter is achieved two diameters of a hole.

If one would want to utilize water from service pipes supplied by U.S. municipal governments with pressure of about 60 psi (or about 4 atm), this can be compared with the water that is applied from a water tank from a height of about h≈42 meters (and in a regular gravity water tank is about h≈0.5 m). These estimations show that water utilization from the service water supplied to our houses would do much better job in terms of water detergency efficiency than the regular water tanks.

Another way of making a toilet with better hygienic qualities is to improve the efficiency of water detergency during water flashing through utilization of specially designed geometry of a bowl exit outlet and a way for water application into a toilet bowl. With the latest trends to water conservation and accepting substantial limitations on utilization of not more than 1.6 gallon of flashing water the available detergency efficiency is reduced significantly. Because, as was noted above, the water action time became much shorter than it was with 5.5 and 3.5 gallons of previous standards. However, there are various ways to improve a water detergency efficiency by forcing a flashing water to flow faster over a bowl surface with a water flow having a swirling motion, often called as a motion with a vortex flow.

There are several patents that introduced more effective ways of water flashing into a water bowl and providing better detergency than in the case of a regular gravity water flashing in a toilet bowl. In U.S. Pat. No. 5,983,413 "High Performance Flush Toilet" by R. Hayashi et al for a better efficient water flashing there is suggested to utilize a combination of a rim-flash, jet-flash and a trap-way siphon providing, as claimed, a maximum flashing. In U.S. Pat. No. 6,986,172 "Flush Toilet" by M. Hidetaka et al there is suggested a toilet with a strong detergency efficiency and with no loud noise utilizing a quite elaborate design of various jet holes in a bowl rim with a water swirl along the inner surface of a water bowl. In U.S. patent application No. 2006/0005310 A1 by K. Nakamura et al there is suggested a design of a flush toilet that produces a vortex flashing water that, as claimed, makes possible to achieve an efficient bowl cleaning and waste discharge with both, a regular water tank and with a service water pipe.

Unfortunately, all above mentioned patents do not give any exact calculations or estimations that justify suggested improvements. Instead, there are often used such uncertain definitions like "it takes much time to produce a siphon action" (U.S. Pat. No. 5,983,413, page 3, line 36), or "when the third means discharges pressurized wash water, the trap-way is filled with wash water promptly, a siphon phenomenon appears promptly (U.S. Pat. No. 6,986,172, page 2, lines 30-33). These examples show qualitative explanations of processes that take place during water flow motions in a toilet bowl, though all claimed positive features might exist.

Our estimation of obtaining an optimum efficiency of water detergency shows that in order to utilize a vortex flow providing good detergency there are certain hydrodynamic phenomena and geometrical factors that must be considered with a bowl design that take place in this case. Our analysis is based on application of the theory of a "shallow water" and the gas-hydraulic analogy that was introduced by N. E. Zhukovski in "Analogy between motion of liquid in a narrow channel and gas motion in a tube with a high speed" published in a "Collection of N. E. Zhukovski Works", v. 7, by All-Union Scientific-Technical Publishing, Moscow (1937) beginning on page 364. A short version of a "shallow water" theory can be found in Theoretical Physics, v. VI, "Hydrodynamics" by L. D. Landau and E. M. Lifshits, "Nauka", Publishing House of Physical-Mathematical Literature, Moscow (1986), beginning on page 569.

The analogy to behavior of a compressible gas represents a motion of incompressible liquid with a free surface in a gravity field, if a depth of a liquid's layer is sufficiently small. The liquid depth must be small in comparison with the characteristic dimensions of a problem, for example, in comparison with dimensions of uneven parts of a reservoir (toilet bowl) where liquid flows. In such a case, a transversal component of a liquid velocity can be neglected in comparison with a longitudinal component, and a longitudinal velocity can be considered as a constant value along a layer's thickness. In this so-called hydraulic approximation, a liquid can be considered as a "two-dimensional" medium possessing in every point a definite velocity V, and also can be characterized by a layer's thickness h.

Euler's general equations of motion provide a solution for the long gravitation waves that represent small disturbances of motion for a considered system. The results (that can be found in above mentioned book by L. D. Landau and E. M. Livshitch, page 570) show that such disturbances propagate in a liquid with a thickness layer h with a finite velocity $C_\lambda$ that equal to $$C_\lambda=(gh)^{1/2}, \quad (3)$$

Where g is a Earth gravity acceleration.

This velocity $C_\lambda$ plays role similar to a sound velocity in gasdynamics. It is necessary to note that, if liquid moves with velocities $V<C_\lambda$ (quiet flow), the influence of disturbances propagates to the entire flow, down and up of a flow. If liquid moves with a velocity $V>C_\lambda$ (fast, or "supersonic" flow), then the influence of disturbances propagates only on certain regions down a flow.

In this invention, the theory of a "shallow water" and the gas-hydraulic analogy are utilized for the description of behavior of a liquid motion in channels with a variable area of a constant depth in a gravitational field. This approach is modified for the case of a fast rotating liquid (water) flow with a vortex having water and a waste through a channel in a shape of a converging-expanding channel (equivalent to a nozzle) that carries water and waste into a drainage channel.

A shallow liquid flow in channels with open surfaces is similar to a gas flow in a tube of a variable cross section. The N. E. Zhukovski's analogy can be used because such flows take place in the potential fields. For example, the change in kinetic energy (velocity) of a liquid flow in an open channel in a gravitation field is a function of a difference in the initial and final potential energies of the liquid as described by the equation:

$$V_{liq}=[2g(h_1-h_0)]^{1/2}, \tag{4}$$

Where $h_0$ and $h_1$ represent the liquid's initial and final heights respectively.

A change of kinetic energy (velocity) of gas in a tube is determined by the difference in a thermal potential that is an enthalpy:

$$V_g=[2(i_1-i_0)]^{1/2}, \tag{5}$$

Where $i_0$ and $i_1$ are enthalpies of gas initial and final states.

From equations (4) and (5) follows that a liquid's depth h serves as an analogue of enthalpy i in gas. Since a hydrostatic pressure in liquid is determined by a liquid's height h, by a formula $P=\rho gh$ (where $\rho$ is a liquid's density), and if $\rho$=const (water is considered as incompressible liquid), then a pressure difference is equivalent to a difference of enthalpies.

The characteristic feature of such floes is a change of flow velocity in a channel with a variable geometry with a transition through a velocity of propagation of disturbances in a flow. For open channel flows of a liquid, this is a velocity for propagation of long waves on a surface of a liquid $C_\lambda$. In the field of gravitation forces this velocity is determined by the formula (3).

From the equation of a constant mass flow conservation for a liquid moving in any arbitrary channel follows that liquid's flow velocity $V_x$ can be determined as:

$$V_x=m/(\rho hL), \tag{6}$$

Where h is a liquid's depth, L is a channel's width, m is a mass flow per unit volume, per second.

From equations (5) and (6) one can determine a liquid depth h, for which a liquid's flow velocity is equal to a velocity of long waves propagation on a liquid's surface, or $V_x=C_\lambda$:

$$h=[m^2/(\rho^2gL^2)]^{1/3}. \tag{7}$$

As a liquid depth h decreases, a liquid's flow velocity $V_x$ increases and a velocity $C_\lambda$ decreases. That is why for any specific value of m and L, there is always a cross section in a channel where both velocities $V_x$ and C are equal (FIG. 1) that can be called a critical flow regime. In analogy with the gasdynamics flows, this cross section is the critical cross section $S_{cr}$, and $h_{cr}$ is the critical depth. Also from here it follows that as flow velocity $V_x$ further increases with the decreasing depth h and the channel length L, this leads to a transition through the characteristic velocity $C_\lambda$, i.e. to the supercritical flow regime with $V_x>C_\lambda$, or, in analogy to gas flows, to the supersonic flow.

Since pressure in a liquid $P=\rho gh$, then the equation (7) can be transformed into the equation:

$$h_{cr}=m^2g/(P^2L^2). \tag{8}$$

In the field of inertia forces of rotating liquid with the development of a gas vortex (because a liquid's layer is quite thin, everyone can always observe an air vortex in a swirling water in a toilet bowl) on a channel's axis, the propagation velocity of long waves $C_\lambda$ on a liquid's surface, correspondingly, is equal:

$$C_\lambda=(jh)^{1/2}, \tag{9}$$

Where $$j=V_\phi^2/r_v \tag{10}$$

is the tangential acceleration of rotating liquid on a vortex surface, $V_\phi$ is the tangential liquid velocity on a vortex surface, $r_v$ is the radius of a gas vortex. Thus, the velocity of long wave propagation on the surface of a gas vortex in a bowl converging-expanding channel (equivalent to a nozzle) $C_\lambda$ depends on the liquid depth h in a nozzle (converging-expanding channel) and the value j of a centrifugal, or tangential acceleration (10) and serves as analogue of a sound velocity.

Here are main assumptions in the theory of a "shallow water" that are illustrated by FIG. 3 that shows a liquid flow in a channel presented by a toilet bowl that has a converging and expanding area in a bowl's exit serving for evacuations:

1. The transverse liquid velocity component $V_z$ of a liquid flow in a vortex's flow is small in comparison with a longitudinal velocity (along a liquid's layer) $V_x$.
2. The longitudinal liquid velocity component $V_x$ is constant across a liquid layer (a gas-hydraulic approximation). Thus, a liquid flowing in a toilet bowl can be characterized as a medium with a certain velocity $V_x$ and a depth h in every point of a converging-expanding channel.
3. A liquid depth h in a toilet bowl is small in comparison with a converging-expanding channel's (nozzle) radius $r_n$ (the most narrow cross section of a converging-expanding channel), i.e. $h<<r_n$.
4. The wave amplitude is not assumed small, as it is normally accepted in the theory of long waves.

The depth h of a converging-expanding channel in a toilet bowl is taking into account that the liquid thickness is small (a "shallow water" approximation) can be determined by combining the relationships: $S=2\pi r_v h$ and $S=\pi(r_n^2-r_v^2)$ and solving for h:

$$h=(r_n^2-r_v^2)/2r_v. \tag{11}$$

From the law of conservation of the momentum $V_\phi r_v=V_{in}R_{in}$ one can determine the tangential velocity of a liquid on a gas vortex surface $V_\phi$:

$$V_\phi=V_{in}R_{in}/r_v \tag{12}$$

Here $R_{in}$ is a radius of a bowl internal side where water enters from a water tank through an inlet orifice; $V_{in}$ is a water velocity at a bowl external side where water enters from a water tank through an inlet orifice of a radius $r_{in}$; $r_v$ is a vortex radius.

And a tangential acceleration of rotating liquid on a vortex surface is $$j=V_{in}^2R_{in}/r_v^3. \quad (13)$$

After substitution of h from (11) and j from (13) into (9) one can obtain a formula for the propagation velocity $C_\lambda$ of long waves on a liquid surface in a toilet bowl converging-expanding channel (nozzle):

$$C_\lambda=(V_{in}R_{in}/r_v^2)[(r_n^2-r_v^2)/2]^{1/2}, \quad (14)$$

The axial (longitudinal) liquid velocity $V_x$ component in a converging-expanding channel (nozzle) is:

$$V_x=m/(\rho 2\pi r_n h), \quad (15)$$

And a liquid mass flow m can be expressed in terms of a radius of an entering port $r_{in}$ and liquid velocity $V_{in}$ at the entering port (for simplicity, one hole is assumed in these estimations) of a bowl (vortex chamber):

$$m=\rho V_{in}\pi r_{in}^2. \quad (16)$$

At the condition that the mass flow of the shallow water component is much less than the total mass flow, i.e. $m_h \ll m$, the axial liquid velocity in the nozzle $V_x$ and the liquid velocity in the vortex chamber (water bowl) entering port $V_{in}$ can be easily connected $$V_x=V_{in}r_{in}^2/(2r_n h). \quad (17)$$

The condition $V_x=C_\lambda$ (a critical flow regime) determines a critical depth $h_{cr}$ of a liquid rotating in a nozzle (converging-expanding channel) as a function of geometrical dimensions of a vortex chamber (toilet bowl):

$$r_{in}^2/(2r_n h_{cr})=(R_{in}/r_v^2)[(r_n^2-r_v^2)/2]^{1/2}. \quad (18)$$

Taking into account (10), and after simple transformations using (16) one can obtain the dependence of the critical liquid depth $h_{cr}$ in a nozzle (converging-expanding channel) as a function of the geometrical parameter A:

$$h_{cr}=r_v/(2A)^{2/3}, \quad (19)$$

Where $$A=R_{in}r_n/nr_{in}^2. \quad (20)$$

The non-dimensional value A is the geometrical characteristic of a chamber with a vortex flow, n is a number of entering ports into a toilet bowl (vortex chamber).

For the non-circular vortex chamber (a toilet bowl) with liquid mass flows entering from ports along the chamber external side wall, the geometrical characteristic of the vortex chamber A is expressed as:

$$A=R_{in}r_n\pi \cos\theta/(nS_r), \quad (21)$$

Where n is the number of entering ports (holes), $S_r$ is the surface area of an entering port (assuming all ports have equal area), θ is the angle between a normal vector to the vortex chamber axis. For simplicity, here and in further estimations n is taken equal to 1. However, for practical estimations one should use a real number of holes in a bowl rim, which is usually is about 26-32 holes (this number varies in different models, which have in general more than 16 holes).

The geometrical characteristic A is the similarity criterion for the devices with rotating liquid and with development of a gas vortex in a liquid. For different dimensions of $R_{in}$, $r_n$, and $r_{in}$ liquid flows are similar at equal values of A. Also, for different values of the geometrical characteristic A from equations (11) and (19) one can determine a radius of a gas vortex $r_v$ at $V_x \geqq C_\lambda$, and $A \geqq 2$ corresponding to the critical regime.

$$r_{vcr}^2=r_n^2[1-(\tfrac{1}{2}A)^{2/3}]. \quad (22)$$

In our experiments for a practical case, the following parameters of a toilet bowl serving as a vortex device (one of standard toilet bowls) were utilized in experiments: $R_{in}$=17 cm, $r_{in}$=3.0 mm=0.3 cm, n=26 (number of holes in a bowl rim), $r_n$=3.0 cm, A=21.8, $V_{in}$=10 m/s, $r_v$=2.9 cm, h=0.1 cm, $V_x$=39 m/s, $C_\lambda$=10.98 m/s, M*=3.55. A mass flow for liquid (water) $m_{in}$ is varied from 6 kg/s to 20 kg/s (meaning that 1.6 gallon≈6 l=6 kg will be released from 1 to 0.3 seconds). For other toilet bowls, these bowl parameters could be slightly different from the above presented, depending on a bowl dimensions, number of holes in a bowl rim, a hole diameter and on a water mass flow. However, the results will be about the same order of values. Note that for the above practical case with $r_n$=3.0 cm and $r_v$=2.9 cm, h=0.1 cm, it means that liquid (water) flows in a quite thin layer of h=0.1 cm with a quite fast velocity $V_x$=39 m/s. In such a case, a detergency efficiency will be increased significantly in comparison with a regular channel. Also a liquid dynamic pressure of such a flow will be about 80 atm.

For mixtures with high percentage of a heavy component such as solid evacuations (usually over 15-20% depending on a ratio of solid evacuations mass flow to a flashed water mass flow) in a liquid mixture it is necessary to include a correction factor into the geometrical parameter A.

From equations (19) and (20) it also follows that for each vortex chamber (various bowl dimensions) geometrical characteristic A there is a certain value of a critical cross section of a liquid flow (a critical depth $h_{cr}$), at which the transition to a supercritical regime of flow is realized. From the nozzle theory, it is known that the critical and supercritical flows correspond to the maximum liquid mass flow through a nozzle (Theoretical Physics, v. VI, "Hydrodynamics" by L. D. Landau and E. M. Lifshits, "Nauka", Publishing House of Physical-Mathematical Literature, Moscow (1986), beginning on page 504). For a liquid flow through a nozzle (converging-expanding channel), similar to a gas flow in a Laval nozzle, a nozzle profile must have a changing (converging-expanding) geometry along its axis. Research with various vortex chambers and with a non-dimensional geometrical parameter A showed that a significant influence of centrifugal forces, due to the sticking and wetting nature of liquids (with exception of mercury), allows a liquid flow (water flow from a bowl during flashing process usually is turned at certain angle after a channel's exit) in a channel with a converging-expanding area to turn at a high angle and avoid atomizing spray effect.

The absence of atomizing effect is very important feature for safe (in a hygienic sense) operation of toilets because a liquid's atomizing can spread undesirable remains from evacuations. Instead, for a changing geometry of a bowl with a converging-expanding channel (nozzle), which is an exit outlet for evacuations, it is possible to create a smooth liquid flow from a nozzle (converging-expanding channel) with very high velocities: for most practical cases, $V_{in}$ is 10-20 m/s and with a utilization of a service water pipe with water pressure of about 60 psi (4 atm), $V_{in}$ can be over 100 m/sec. Meaning that $V_x$ can be substantially higher, as it was shown in above practical case. Also, liquids moving without atomizing effect produce practically no noise.

A ratio $V_x/C_\lambda$=M*=1, where M* is an analogue of the Mach number M in gas, in a rotating liquid is achieved at A=2 (FIG. 1*b*). Just as the M number serves as a similarity criterion for gas flows, the M* is an analogous similarity criterion for liquid flows of a small depth.

The regime of a critical and supercritical flow in a nozzle (converging-expanding channel) is realized for the geometrical characteristic $A \geqq 2$ ($M^* \geqq 1$). It requires observance of the definite conditions for liquid flow from a vortex chamber (bowl space) into a converging-expanding channel. Exit flow of a liquid flow with evacuations through long converging-expanding channels (nozzles) leads to development of pressure waves in such channels. This phenomenon is similar to appearance of shock waves that occur when gases are expelled from a nozzle of a liquid-propellant rocket. Transitions from supercritical to undercritical regime of flow in long channels are caused by flow discontinuities arising from friction (FIG. 3*a*).

Intense disturbance of a liquid flow with additives (evacuations) causes a development of large-scale waves (liquid jumps) and leads to the decrease of a detergency efficiency and to the increase of energy losses. Efforts for the increase of the time for action of centrifugal forces in a liquid by the increase of a channel length or the decrease of its diameter do not produce necessary qualities (higher liquid flow velocity, higher detergency, lower atomizing effect).

Continuing the analogy with a gas flow, it is essential to note that the number M* depends not only on the ratios of areas but it depends also on the ratio of pressures and densities in a nozzle. In order to observe a critical flow regime in a nozzle (expanding-converging channel) it is necessary to have a certain pressure difference between a volume from where a flow is coming out and a pressure of the surrounding media to where a flow is coming in. This relationship has the form:

$$P_0/P_{cr}=[(\kappa+1)/2]^{\kappa/(\kappa-1)}, \tag{23}$$

Where $k=C_p/C_v$ is a ratio of specific heats, or an adiabatic coefficient. With this condition, a flow velocity is equal to a local velocity of sound, or, which is the same for a liquid moving in a thin layer of a nozzle (converging-expanding channel), an axial component of flow velocity $V_x$ is equal to a local velocity for propagation of long waves over its surface $C_\lambda$, or $V_x=C_\lambda$.

The decrease of pressure $P_0$, or the increase of the critical pressure $P_{cr}$, leads to the decrease of exit velocity that is less than the local velocity of sound ($M^*<1$). The increase of pressure in a volume doesn't lead to the increase of the M* number, it only increases pressure at nozzle (converging-expanding channel) exit. Exit flow velocity can increase only with a corresponding increase in the sound velocity. For the case of a liquid flow, this corresponds to a requirement for an increase of the propagation velocity of long waves. This is achieved by a variation of either a liquid's depth h, or a centrifugal acceleration j.

Unlike gas under excess pressure at a nozzle exit, liquid cannot expand without losing continuity when leaving a nozzle (converging-expanding channel). Instead, the extra pressure must be completely transformed to kinetic energy within a nozzle (converging-expanding channel), as a liquid exits. This process takes place in a nozzle (converging-expanding channel). A transformation of extra centrifugal pressure into a dynamic pressure occupies a certain length of a nozzle (converging-expanding channel). If one can assume that potential energy makes a transition into kinetic energy without a discontinuity (rarefaction discontinuities exist only at special conditions), it follows that with the increase of pressure difference at a nozzle (converging-expanding channel) a critical cross section moves inside of a nozzle (converging-expanding channel). That means that a converging-expanding channel should have a flexible certain length with areas having radius $r_n$ satisfying the conditions $A \geqq 2$.

Also, a lower part of bowl and in a converging-expanding channel water flow supplied by a water tank through bowl rim holes interacts with a water, or a water jet (depends on a toilet design) that is at a bowl's bottom. Such interaction leads to a certain decrease of water velocity applied from bowl's holes. Taking into account that water has quite a low viscosity, this friction is not high. Our estimations show velocity decrease not more than 15% from the supplied at rim's holes. For a water jet applied under a bowl exit, in the case of the same water direction from a bowl rim and a jet, there is practically no friction.

Thus, a critical cross section is determined by the value $M^*=1$. This cross section also can be determined through pressure. For this purpose, one can substitute in equation (23) an adiabatic coefficient $\kappa=2$:

$$P_0^*/P_{cr}^*=(3/2)^2=2.25, \text{ or } P_{cr}^*=0.445P_0^*. \tag{24}$$

Detailed analysis shows that for the existence of the critical and supercritical regime of flow in a converging-expanding channel of a vortex flow in a toilet bowl it is necessary and sufficient that an average pressure on a toilet bowl water flow $\Delta P_{av}$ is higher, or equal to 1.5 of an average extra pressure in a nozzle's (converging-expanding channel) critical cross section $\Delta P_{cr.av}$:

$$\Delta P_{av} \geqq 1.5\Delta P_{cr.av*} \tag{25}$$

In simple terms, it means that water pressure of over 1.5 atm (over an atmosphere pressure, plus a possible correction factor of about 15% for a friction during interaction with water at bowl's bottom) is necessary to provide a supercritical liquid flow regime that allows to have a flow with least disturbances.

The principle of a maximum mass flow is satisfied for this condition (25). At $\Delta P_{av}<1.5\ P_{cr.av}$ one can have a subcritical flow condition for which the principle of the maximum flow in a nozzle (converging-expanding channel) doesn't take place.

In conclusion, a nozzle with a shape converging-expanding areas (similar to Laval's nozzle) permits to have critical, or supercritical liquid flow in a thin liquid layer providing maximum liquid mass flow without disturbances in the vortex chamber (toilet bowl). Toilet bowls serving as vortex devices utilizing such liquid flow (water) with a converging-expanding channel (nozzle) provide very efficient and optimal flow of liquid without disturbances and atomizing effects, which is necessary for a hygienic high detergency toilet operation.

BEST MODE FOR CARRYING OUT THE INVENTION

Referring to FIG. 1*a*, there are presented the graphical dependencies of a velocity of liquid's surface waves $C_\lambda$ and a flow velocity $V_x$ as a function of a liquid flow thickness h. In FIG. 1*b* there are presented graphical dependencies of a liquid surface wave velocity $C_\lambda$ and a liquid flow velocity $V_x$ as a function of a geometrical non-dimensional parameter A. These graphical dependencies can be utilized for quantitative calculations of specific parameters of existing toilets when makers of toilets want to estimate if their designed toilets operate in optimum modes: at high liquid flow velocities and correspondingly high detergency efficiency and without flow disturbances and atomizing effects with the non-dimensional parameter $A \geqq 2$.

Referring to FIG. 2, there is presented a schematic drawing for a liquid flow explaining the main assumptions of the theory of "shallow water". The descriptions of the theoretical explanations of application of a "shallow water" approach in liquid flow for a toilet bowl were given above. Letters $r_n$, $r_v$, h and $V_x$ are a radius of a converging expanding channel (nozzle), a radius of a gas (air) vortex of a flow that takes place in a toilet bowl, a thickness of a liquid (water) flow and a velocity of a liquid (water) flow in a bowl, correspondingly.

Referring to FIG. 3*a*, there is presented a picture explaining transitions from supercritical regime of flow in a long channel (no converging-expanding channel) leading to a flow with discontinuities arising from friction. This picture shows development of a flow with discontinuities 30 leading to shock waves that are typical in gasdynamic flows. FIG. 3*b* presents a liquid flow with flow motion through a converging-expanding channel 31 providing no discontinuities outside of a converging-expanding area.

Figure 4:
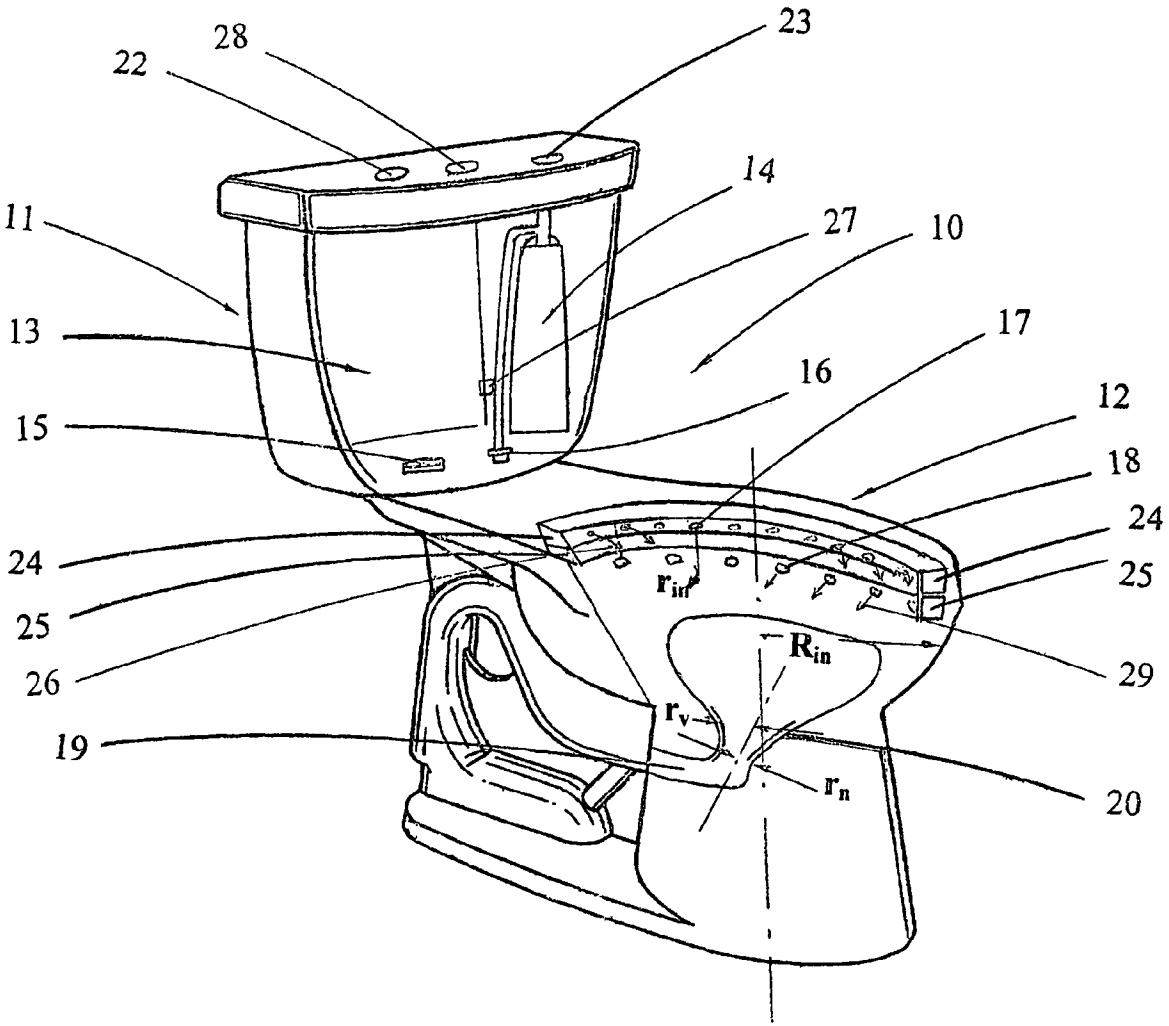
FIG. 4 is a schematic diagram of a toilet tank comprising of two compartments: one is for flash water and another one for a liquid self-foaming soap.

FIG. 4 is a schematic drawing of a toilet 10 of the present invention. This toilet comprises of two parts: a tank 11 having two compartments: the first compartment is for flash water 13 and the second compartment 14 for a liquid self-foaming soap, and a toilet bowl 12. A push button 22 serves for a water flashing and a push button 23 serves for a soap foam application. Flash water from a compartment 13 is applied into a rim 24 of a bowl 12 through an inlet orifice 15. A soap foam from a compartment 14 is applied into a second bowl rim 25 through an inlet 16. As one can see, on FIG. 4, there is shown a toilet bowl 12 with two separate rims 24 and 25: one is for flashing water and another one for a soap foam, with placement of smaller holes 17 that provide a flow of flashing water for washing out evacuations and water, and a foamy soap and with placement of larger holes 18 that provide a flow of foamy soap for filling in a bowl surface and a water surface at a bowl bottom part. Smaller holes 17 for flashing water have exit direction 26 at a low angle to a bowl axis, tangentially to a bowl surface to force water flows to swirl around a bowl internal body with transition of each separate flow from small holes into a main water flow with a vortex for maximum efficiency of detergency. Larger holes 18 for a foam soap have exit direction 29 in general perpendicular to a bowl surface.

A push button 22 also serves for application of water from a water compartment 13 into a bowl foam rim 24 through a valve 27 having a push button 28. This valve 27 and a push button 28 are utilized only if it is necessary to wash a soap residue that can dry out in the case of not utilizing a foam soap for a period of several months and a bowl rim for a soap foam 24 will be filled with a soap residue. Our experiments with a soap foam left for a period of five days showed that foam is drying out only at a distance of about 1.0-1.5 cm deep inside of a foam bowl rim and a soap residue do not produce any noticeable effect on a foam motion. Moreover, a soap dried residue becomes dissolved with next portion of applied foam from a self-foaming compartment 14.

FIG. 4 also presents a schematic drawing of a toilet bowl exit 19 with converging-expanding channel 20 for obtaining the optimum detergency efficiency of a bowl by a high velocity, high pressure liquid flow with vortex. The dimensions of this toilet bowl are selected so that the non-dimensional geometrical parameter A provides a "supersonic" flow of liquid at value of the non-dimensional geometrical parameter $A \geqq 2$.

FIG. 4 presents a schematic drawing of a toilet bowl with geometric dimensions for understanding of the application of the theory of hydrodynamic flow in a bowl with a vortex and dimensions of important geometrical parameters for calculation of the non-dimensional geometrical parameter A characterizing similar flows in a toilet bowl. These dimensions of a toilet bowl are as follows: $R_{in}$ is a radius of a bowl external side where water enters from a water tank through inlet orifices (holes) of a radius $r_{in}$, $r_n$ is a radius of a bowl converging expanding channel serving as a bowl exit outlet, in its narrow cross section (nozzle "throat"), $r_v$ is a vortex radius.

What is claimed is:

1. A hygienic high detergency toilet comprising:

a toilet water tank with two compartments-containers: a first compartment with water that serves as a regular water tank for water flash through an inlet orifice supplying water into a toilet bowl through a rim and from the bowl rim into a bowl volume situated under the rim, which is a hollow space providing a channel for water and situated horizontally with respect to a bowl upper surface; a second compartment for containing a liquid self-foaming soap that serves as a supply of a soap foam applied through another inlet orifice into the toilet bowl having a hollow second rim with a space separated from a space assigned for water, a soap foam is moved by pressure produced by a self-foaming soap from the second compartment-container that mixes air with liquid soap and produces a foaming soap;

means for supplying water into a toilet bowl through a rim, which is a hollow space on a top of a ceramic bowl, separated from the main body of toilet bowl; this bowl rim is equipped with a plurality of over 15 and up to 50 small holes of 5-6 mm in diameter with holes exit direction at a small angle to a bowl axis, tangentially to a bowl surface for producing a water swirl around a bowl internal body making transition of each separate flow from small holes into a main water flow with a vortex for maximum efficiency and cleaning of a bowl surface;

means for supplying the soap foam into a second toilet bowl rim, which is a hollow space of a ceramic bowl under the rim for water, separated from main body of a toilet bowl; this rim is equipped with a plurality of over 9 and up to 30 larger holes of 10-15 mm in diameter with exit direction, in general, perpendicular to a bowl surface for producing a flow of foam into a bowl surface and onto a water surface at a bowl bottom;

means for forming a layer of foam of about one half inch and up to one inch thickness serving for absorption of evacuations and suppressing water and the bowl surface's ability to reflect evacuated particles back to a user;

means for a connection of a water compartment flow line of a toilet water tank with a soap foam line for cleaning of a soap foam line with water;

means for arranging water and evacuations flow through a converging-expanding channel designed for a maximum water and evacuations flow velocity and high pressure for obtaining high cleaning effect in a toilet bowl and having a liquid flow without disturbances in a converging-expanding channel serving for removal of water and evacuations so there are no observed splashes and no atomizing spray effect leading to possible reflections back to a user; this means provides a bowl bottom exit in a shape of a converging-expanding channel having certain geometrical relationships of bowl dimensions for a liquid release through a bowl with organization of a liquid flow with vortex, with the most optimum operation of a liquid vortex providing a high cleaning efficiency with the geometrical non-dimensional number satisfying the condition of $A \geqq 2$, where the geometrical parameter $A=R_{in}r_n/nr_{in}^2$ is the similarity criterion and the value $R_{in}$ is a toilet bowl internal radius in the place of flashing water entering holes, $r_n$ is the radius of a converging-expanding exit channel-nozzle in its narrow converging area, $r_{in}$ is the radius of a flushing water entering hole, and n is a number of flushing water entering holes of a toilet bowl; and for a non-circular vortex chamber, i.e. toilet bowl, the geometrical parameter $A=R_{in}r_n\pi \cos \theta/(nS_r)$, where $S_r$ is the surface area of an entering hole, $\theta$ is the angle between a normal vector to the vortex chamber-toilet bowl's axis.

2. The hygienic toilet according to claim 1 where instead of a regular water tank that provides a passive release of water at low height there is utilized a pressure-assisted service water pipe with a regular water line, or pump that releases water stored in a water tank to a substantially higher pressure at a shorter action time, providing higher liquid flow velocity with higher cleaning efficiency.

3. The hygienic toilet of claim 1 with a bowl rim for foam having holes of 10-15 mm in diameter placed in immediate vicinity to a bowl's water surface, about 10-20 mm over the water surface, lower than the water rim by 100-200 mm depending on a bowl height, for fast efficient release of a soap foam, close to a water surface.

4. The hygienic toilet of claim 2 with a bowl rim for foam having holes of 10-15 mm in diameter placed in immediate vicinity to a bowl's water surface, about 10-20 mm over the water surface, lower than the water rim by 100-200 mm depending on a bowl height, for fast efficient release of a soap foam close to a water surface.

* * * * *